US008910703B2

(12) United States Patent
Kim et al.

(10) Patent No.: US 8,910,703 B2
(45) Date of Patent: Dec. 16, 2014

(54) HEAT EXCHANGER

(75) Inventors: Hyunyoung Kim, Sakai (JP); Haruo Nakata, Sakai (JP); Hirokazu Fujino, Sakai (JP); Toshimitsu Kamada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 816 days.

(21) Appl. No.: 12/997,076

(22) PCT Filed: Jun. 17, 2009

(86) PCT No.: PCT/JP2009/002756
§ 371 (c)(1),
(2), (4) Date: Dec. 9, 2010

(87) PCT Pub. No.: WO2009/153985

PCT Pub. Date: Dec. 23, 2009

(65) Prior Publication Data

US 2011/0139428 A1 Jun. 16, 2011

(30) Foreign Application Priority Data

Jun. 20, 2008 (JP) ..... 2008-162062

(51) Int. Cl.

| | |
|---|---|
| ***F28D 1/02*** | (2006.01) |
| ***F28F 1/32*** | (2006.01) |
| ***F28D 1/053*** | (2006.01) |
| ***F28F 1/34*** | (2006.01) |
| ***F28F 1/12*** | (2006.01) |
| ***F28F 17/00*** | (2006.01) |
| *F28F 1/20* | (2006.01) |

(52) U.S. Cl.

CPC ..... *F28F 1/325* (2013.01); *F28D 1/05391* (2013.01); *F28F 1/34* (2013.01); *F28F 1/128* (2013.01); *F28F 17/005* (2013.01)

USPC ..... 165/152; 165/181

(58) Field of Classification Search

CPC ..... F28F 1/126; F28F 1/128; F28F 1/325; F28F 2215/08; F28F 1/34; F28F 17/005; F28D 1/05391

USPC ..... 165/152, 153, 181, 831, 183

See application file for complete search history.

(56) References Cited

U.S. PATENT DOCUMENTS

| | | | | |
|---|---|---|---|---|
| 5,787,972 | A * | 8/1998 | Beamer et al. | 165/152 |
| 2009/0173479 | A1* | 7/2009 | Huang | 165/152 |
| 2011/0036550 | A1* | 2/2011 | Jiang et al. | 165/173 |

FOREIGN PATENT DOCUMENTS

| | | | |
|---|---|---|---|
| JP | 58-188569 | U | 12/1983 |
| JP | 63-6632 | Y2 | 2/1988 |
| JP | 9-101092 | A | 4/1997 |
| JP | 2008-101847 | A | 5/2008 |

OTHER PUBLICATIONS

International Search Report of corresponding PCT Application No. PCT/JP2009/002756.

(Continued)

*Primary Examiner* — Tho V Duong
(74) *Attorney, Agent, or Firm* — Global IP Counselors

(57) ABSTRACT

A heat exchanger includes a plurality of flat tubes and at least one wavily folded fin disposed between a pair of the flat tubes. The fin includes a heat transfer portion having a folded portion joined to a planar portion of each of the pair of flat tubes, and a cut-and-raised portion. The cut-and-raised portion is formed by raising a periphery of a cutting line segment when a material of the fin is wavily folded. The cutting line segment is set in a vicinity of a hypothetical center line of the folded portion before the material of the fin is wavily folded. The cutting line segment is formed by a combination of cutting line segments intersecting with the hypothetical center line, or a combination of a cutting line segment intersecting with the hypothetical center line and a cutting line segment displaced with respect to the hypothetical center line.

4 Claims, 7 Drawing Sheets

(56) References Cited

OTHER PUBLICATIONS

European Search Report of corresponding EP Application No. 09 76 6433.8 dated Feb. 21, 2014.

International Preliminary Report of corresponding PCT Application No. PCT/JP2009/002756, Feb. 14, 2014.

* cited by examiner

HEAT EXCHANGER

CROSS-REFERENCE TO RELATED APPLICATION

This U.S. National stage application claims priority under 35 U.S.C. §119(a) to Japanese Patent Application No. 2008-162062, the entire contents of which are hereby incorporated herein by reference.

TECHNICAL FIELD

The present invention relates to a heat exchanger provided with flat tubes and fins.

BACKGROUND ART

The heat exchangers of a widely prevailed type are structured as follows. Planar portions of a single flat tube are horizontally disposed while fins are respectively interposed between given two adjacent planar portions (see Japan Examined Utility Application Publication No. 63-006632). Japan Examined Utility Model Application Publication No. S63-006632 describes a heat exchanger that each of the fins includes a plurality of protruding portions protruded to the downstream of airflow and each of the protruding portions includes a cutout. Condensed dew, generated in the heat exchanger, gathers in the downstream of airflow and drops downwards through the cutouts. However, the condensed dew normally drops through the cutouts when becoming larger to naturally drop due to its weight. Otherwise, the condensed dew is accumulated in the heat exchanger. In this case, the condensed dew blocks ventilation and accordingly deteriorates heat exchange performance of the heat exchanger. In view of the above, the applicant of the present invention developed a heat exchanger having an enhanced drainage performance with respect to condensed dew. Specifically, the heat exchanger has a structure that the fins are respectively interposed between given two adjacent planar portions while being protruded from the edges of the planar portions. Accordingly, condensed dew flows downwards through the protruded portions of the fins (see Japan Laid-open Patent Application publication No. 2008-101847)

There have been further increasing demands for reduction in size of the heat exchangers. However, reduction in size of the heat exchangers may possibly deteriorate drainage performance of the heat exchangers with respect to condensed dew. In response, there have been demands for further enhancement in drainage performance of the heat exchangers.

SUMMARY

Technical Problem

It is an object of the present invention to provide a heat exchanger having enhanced drainage performance with respect to condensed dew.

Solution to Problem

A heat exchanger according to a first aspect of the present invention includes flat tubes and a single or plurality of fins. The flat tubes are disposed in a plurality of tiers. Each of the flat tubes includes a planar portion vertically faced. Each of the fins is disposed in a wavily folded state in a ventilation space interposed between the flat tubes disposed on given two vertically adjacent tiers. Each of the fins includes a heat transfer portion and a cut-and-raised portion. The heat transfer portion has a folded portion joined to the planar portion of each of the flat tubes. The cut-and-raised portion is protruded from the ventilation space. The cut-and-raised portion is formed by raising a periphery of a cutting line segment when a material of the fins is wavily folded. The cutting line segment is set in a vicinity of a hypothetical center line of the folded portion before the material of the fins is wavily folded. Further, the cutting line segment is formed by a combination of cutting line segments intersecting with the hypothetical center line or a combination of a cutting line segment intersecting with the hypothetical center line and a cutting line segment displaced with respect to the hypothetical center line.

According to the heat exchanger of the first aspect of the present invention, the cut-and-raised height of each cut-and-raised portion is increased. The cut-and-raised portions of the fins on given two vertically adjacent tiers thereby easily make contact with each other. Simultaneously, the contact portion between the cut-and-raised portions thereon is increased. Consequently, condensed dew on the surfaces of the fins disposed on the upper tiers easily flows onto the surfaces of the fins disposed on the lower tiers. In other words, good drainage performance is achieved.

A heat exchanger according to a second aspect of the present invention relates to the heat exchanger according to the first aspect of the present invention. In the heat exchanger, the cutting line segment includes a first cutting line segment and a second cutting line segment. The first cutting line segment intersects with the hypothetical center line. The second cutting line segment intersects with the hypothetical center line while being extended from a vicinity of a terminal of the first cutting line segment.

According to the heat exchanger of the second aspect of the present invention, long distance is produced from the base to the apex of each cut-and-raised portion. Accordingly, the contact amount is increased between the cut-and-raised portions of the fins disposed on given two vertically adjacent tiers.

A heat exchanger according to a third aspect of the present invention relates to the heat exchanger according to the first aspect of the present invention. In the heat exchanger, the cutting line segment includes a first cutting line segment and a second cutting line segment. The first cutting line segment intersects with the hypothetical center line. The second cutting line segment does not intersect with the hypothetical center line while being extended from a vicinity of a terminal of the first cutting line segment.

According to the heat exchanger of the third aspect of the present invention, long distance is produced between the base of each cut-and-raised portion and the upwardly or downwardly faced edge of each cut-and-raised portion. Accordingly, the contact amount is further increased between the cut-and-raised portions of the fins disposed on given two vertically adjacent tiers.

A heat exchanger according to a fourth aspect of the present invention relates to the heat exchanger according to the first aspect of the present invention. In the heat exchanger, the cutting line segment includes a first cutting line segment, a second cutting line segment, a third cutting line segment, and a fourth cutting line segment. The first cutting line segment intersects with the hypothetical center line. The second cutting line does not intersect with the hypothetical center line while being extended from a vicinity of a terminal of the first cutting line segment. The third cutting line segment intersects with the hypothetical center line while being extended from a vicinity of a terminal of the second cutting line segment. The fourth cutting line segment does not intersect with the hypothetical center line while being extended from a vicinity of a terminal of the third cutting line segment.

According to the heat exchanger of the fourth aspect of the present invention, two cut-and-raised portions are formed in a periphery of the cutting line segment. Therefore, high contact reliability is achieved between the cut-and-raised portions of the fins disposed on given two vertically adjacent tiers.

Advantageous Effects of Invention

According to the heat exchanger of the first aspect of the present invention, the cut-and-raised height of each cut-and-raised portion is increased. The cut-and-raised portions of the fins on given two vertically adjacent tiers thereby easily make contact with each other. Simultaneously, the contact portion between the cut-and-raised portions thereon is increased.

Consequently, condensed dew on the surfaces of the fins disposed on the upper tiers easily flows onto the surfaces of the fins disposed on the lower tiers. In other words, good drainage performance is achieved.

According to the heat exchanger of the second aspect of the present invention, long distance is produced from the base to the apex of each cut-and-raised portion. Accordingly, the contact amount is increased between the cut-and-raised portions of the fins disposed on given two vertically adjacent tiers. Consequently, condensed dew easily flows along the cut-and-raised portions.

According to the heat exchanger of the third aspect of the present invention, long distance is produced between the base of each cut-and-raised portion and the upwardly or downwardly faced edge of each cut-and-raised portion. Accordingly, the contact amount is further increased between the cut-and-raised portions of the fins disposed on given two vertically adjacent tiers. Consequently, condensed dew easily flows along the cut-and-raised portions.

According to the heat exchanger of the fourth aspect of the present invention, two cut-and-raised portions are formed in a periphery of the cutting line segment. Therefore, high contact reliability is achieved between the cut-and-raised portions of the fins disposed on given two vertically adjacent tiers.

DESCRIPTION OF EMBODIMENTS

An exemplary embodiment of the present invention will be hereinafter explained with reference to figures. It should be noted that the following exemplary embodiment is a specific example of the present invention and the technical scope of the present invention is not thereby limited.

<Structure of Heat Exchanger 10>

Figure 1:
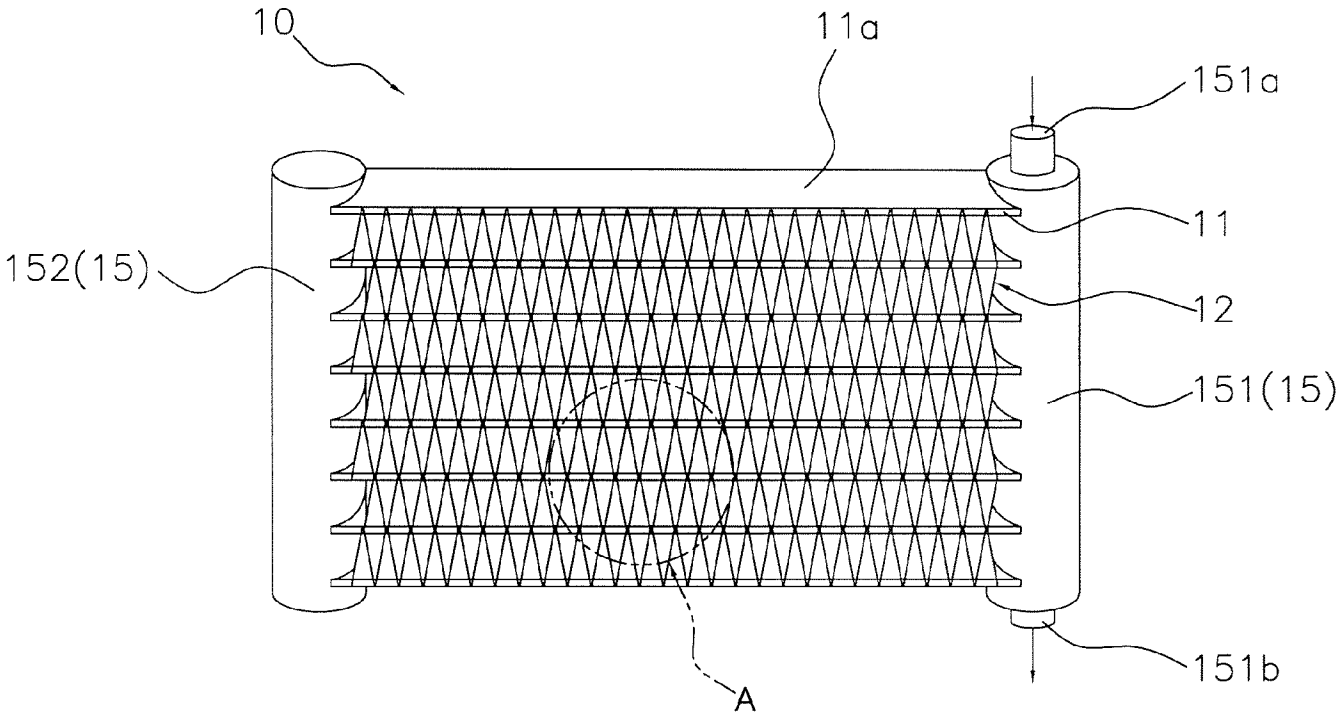
FIG. 1 is an external perspective view of a heat exchanger according to an exemplary embodiment of the present invention.
Figure 2:
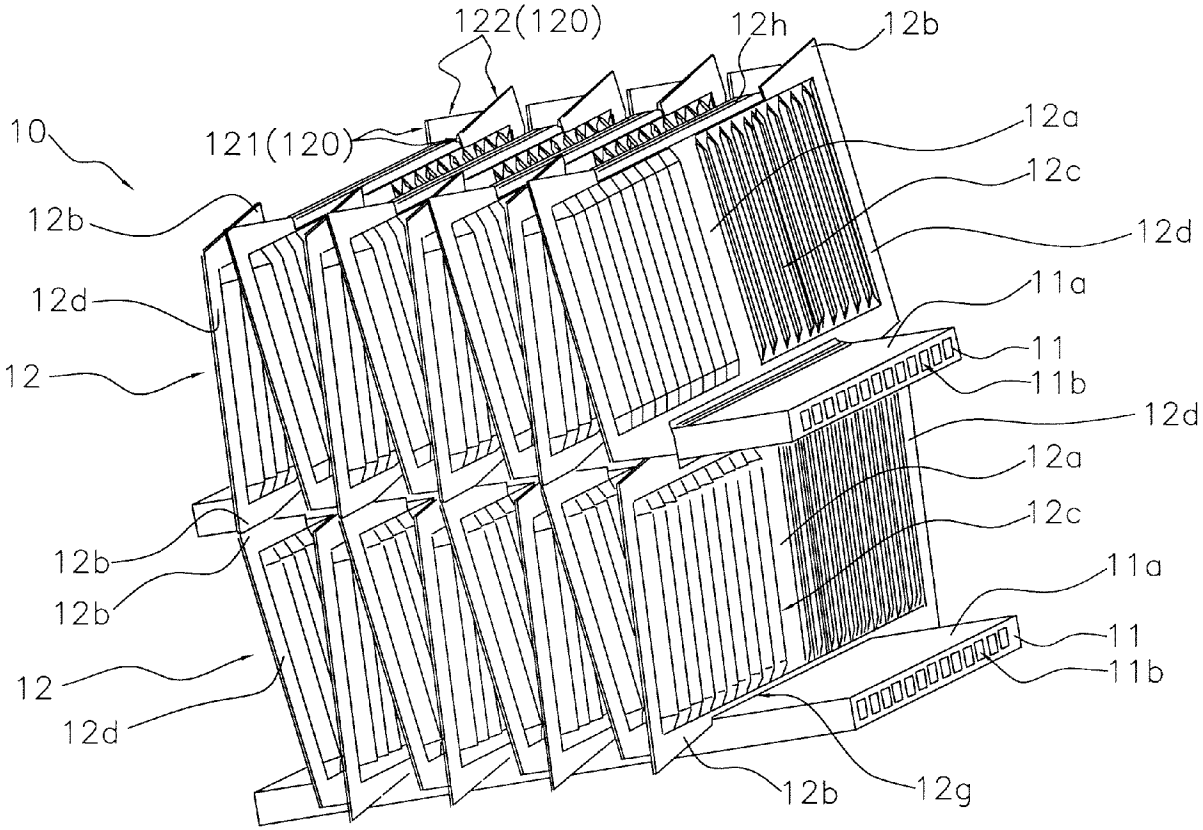
FIG. 2 is an enlarged perspective view of a section A in FIG. 1.

FIG. 1 is an external perspective view of a heat exchanger according to the exemplary embodiment of the present invention. FIG. 2 is an enlarged perspective view of a section A in FIG. 1. In FIGS. 1 and 2, a heat exchanger 10 includes flat tubes 11, wavy fins 12, and headers 15.

(Flat Tubes 11)

The flat tubes 11 are molded using aluminum or aluminum alloy. Each flat tube 11 includes a planar portion 11*a* and a plurality of refrigerant flow paths 11*b* (see FIG. 2). The planar portion 11*a* functions as a heat transfer surface, whereas the refrigerant flow paths 11*b* allow refrigerant to flow therethrough. As illustrated in FIG. 2, the flat tubes 11 are disposed in a plurality of tiers while the planar portions 11*a* thereof are respectively vertically faced.

(Wavy Fins 12)

The wavy fins 12 are wavily folded fins made of aluminum or aluminum alloy. As illustrated in FIG. 2, the wavy fins 12 are disposed in ventilation spaces interposed between given two vertically adjacent flat tubes 11. In each wavy fin 12, a valley portion 12*g* and a mountain portion 12*h* respectively make contact with the planar portions 11*a* of given two vertically adjacent flat tubes 11. It should be noted that brazing is executed for welding of the valley portion 12*g* and the planar portion 11*a* and welding of the mountain portion 12*h* and the planar portion 11*a*.

A heat transfer surface 12*a* of each wavy fin 12 is a portion for exchanging heat with air passing through the ventilation space. The heat transfer surface 12*a* includes louvers 12*c* for efficiently executing heat exchange. Each louver 12*c* is formed as an opening penetrating both faces of the heat transfer surface 12*a*. When each heat transfer surface 12*a* is seen from the front side in FIG. 2, the right-side face of each heat transfer surface 12*a* is referred to as "a first face", whereas the left-side face thereof is referred to as "a second face" for convenience of explanation. Airflow passes through each transfer surface 12*a* while flowing along the first and second faces thereof. Therefore, a group of the louvers 12*c*, positioned on the upstream of the center part of each transfer surface 12*a*, is slanted for allowing air to flow from the second face to the first face. On the other hand, a group of the louvers 12*c*, positioned on the downstream of the center of each transfer surface 12*a*, is slanted for allowing air to flow from the first face to the second face.

(Header 15)

In FIG. 1, the headers 15 are coupled to the both ends of the respective flat tubes 11 vertically disposed in a plurality of tiers. In the front view of FIG. 1, the right-side header is referred to as "a first header 151" while the left-side header is referred to as "a second header 152" for convenience of explanation. The first and second headers 151, 152 have functions of supporting the flat tubes 11; guiding refrigerant to the refrigerant flow paths 11*b* of the flat tubes 11; and gathering the refrigerant flowed out of the refrigerant flow paths 11*b*.

(Flow of Refrigerant)

In FIG. 1, refrigerant flows into the first header 151 through an inlet 151*a*. Subsequently, the refrigerant is roughly equally distributed into the respective refrigerant flow paths 11*b* of the flat tube 11 disposed on the highest tier, and flows towards the second header 152. When reaching the second header 152, the refrigerant is roughly equally distributed into the respective refrigerant flow paths 11*b* of the flat tube 11 disposed on the second highest tier, and flows towards the first header 151. Similarly, the refrigerant within the flat tubes 11 on the subsequent odd-numbered tiers flows towards the second header 152, whereas the refrigerant within the flat tubes 11 on the subsequent even-numbered tiers flows towards the first header 151. Finally, the refrigerant within the flat tube 11 on the lowest even-numbered tier flows towards the first header 151. The refrigerant gathers in the first header 151, and flows out of an outlet 151*b*.

The refrigerant, flowing through the refrigerant flow paths 11*b*, absorbs heat from airflow flowing through the ventilation space through the wavy fins 12, when the heat exchanger 10 functions as an evaporator. In contrast, the refrigerant, flowing through the refrigerant flow paths 11*b*, discharges heat to the airflow flowing through the ventilation space through the wavy fins 12, when the heat exchanger 10 functions as a condenser.

(Flow of Condensed Dew)

In general, the surface of the heat exchanger has poor drainage performance when the respective flat tubes 11 are disposed while the planar portions 11*a* are vertically faced. When the heat exchanger is used as an evaporator, accumulated condensed dew blocks airflow. Accordingly, heat exchange performance of the heat exchanger may be deteriorated.

According to the heat exchanger 10 of the present exemplary embodiment, however, the width of each wavy fin 12 is set to be greater than the width of each flat tube 11 as illustrated in FIG. 2. In other words, the both ends of each wavy fin 12 are protruded out of the ventilation space. Condensed dew thereby flows downwards through the both ends of each wavy fin 12. Consequently, condensed dew is prevented from being accumulated on the wavy fins 12. It should be noted that the portions of each wavy fin 12, protruded out of the ventilation space, are hereinafter referred to as "water guide portions 12*d*".

It is preferable to have the following structure for achieving good drainage performance with respect to condensed dew. Each water guide 12*d* of each wavy fin 12 disposed on the upper one of given two vertically adjacent tiers makes contact with each water guide 12*d* of each wavy fin 12 disposed on the lower one of the given two vertically adjacent tiers. In the heat exchanger 10 of the present exemplary embodiment, as illustrated in FIG. 2, each of the water guide portions 12*d* on the given two vertically adjacent tiers includes cut-and-raised portions 12*b* on the top and bottom edges thereof. Each cut-and-raised portion 12*b* protrudes at an acute angle. With the structure, the cut-and-raised portions 12*b* on the given two vertically adjacent tiers make contact with each other. The cut-and-raised portions 12*b* are formed (i.e., cut and raised) from a plate material when the plate material is wavily folded for forming the wavy fins 12. The cut-and-raised portions 12*b* will be hereinafter explained with reference to figures.

(Cut-and-Raised Portions 12*b*)

Figure 3:
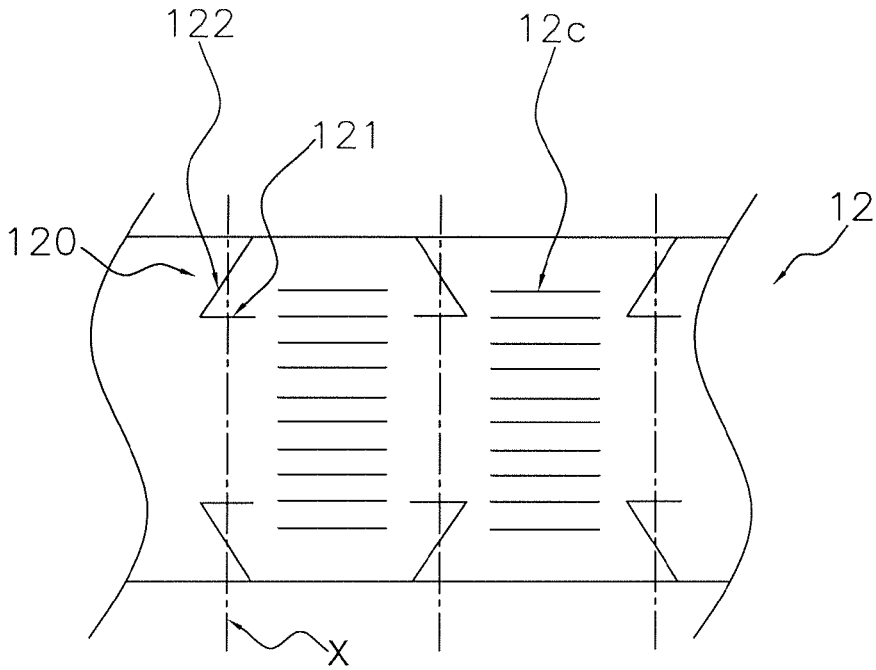
FIG. 3 is a plan view of a wavy fin of a pre-wavily-folded state.

FIG. 3 is a plan view of the wavy fins of a pre-wavily-folded state. In FIG. 3, the wavy fins 12 of a pre-folded state include a plurality of groups of the louvers 12*c* longitudinally formed thereon at equal intervals. An area, interposed between given two adjacent groups of the louvers 12*c*, is respectively changed into the valley portion 12*g* or the mountain portion 12*h* after bending of the wavy fins 12. The area will be hereinafter referred to as "a prospective folded area".

In each prospective folded area, first cutting line segments 121 are set in positions separated inwards from the both edges of the prospective folded area at a predetermined distance. The first cutting line segments 121 are perpendicular to a hypothetical center line X of the prospective folded area. An arbitrary length may be set for each first cutting line segment 121 as long as the length is roughly equal to the thickness of each flat tube 11. Further in each prospective folded area, second cutting line segments 122 are set to intersect with the hypothetical center line X. Each second cutting line segment 122 is extended from a terminal of each first cutting line segment 121 towards an edge of the prospective folded area. The first and second cutting line segments 121, 122 will be hereinafter inclusively referred to as "cutting line segments 120".

When each prospective folded area is actually folded in a mountain shape or a valley shape, an acute triangle portion formed by each first cutting line segment 121 and each second cutting line segment 122 and another acute triangle portion formed by each second cutting line segment 122 and each edge of the prospective folded area are both cut and raised. Accordingly, the both triangle portions are formed as the cut-and-raised portions 12*b*. In each wavy fin 12, the cut-and-raised portions 12*b* are protruded upwards or downwards as illustrated in FIG. 2. Therefore, the cut-and-raised portions 12*b* of the wavy fins 12 on given two vertically adjacent tiers make contact with each other.

Consequently, condensed dew flows downwards along the water guide 12*d* of each wavy fin 12 on the upper one of the given two vertically adjacent tiers. Further, condensed dew flows from the cut-and-raised portion 12*b* of each wavy 12 thereon to the cut-and-raised portion 12*b* of each wavy fin 12 on the lower one of the given two vertically adjacent tiers. Yet further, condensed dew flows downwards through the water guide 12*d* of each wavy fin 12 on the lower one of the given two vertically adjacent tiers.

<Features>

In the heat exchanger 10, the material of the wavy fins 12 of a pre-wavily-folded state is provided with the first cutting line segments 121 and the second cutting line segments 122. In each prospective folded area, each first cutting line segment 121 intersects with a hypothetical center line X whereas each second cutting line segment 122 is extended from the vicinity of a terminal of each first cutting line segment 121 while intersecting with the hypothetical center line X. When the material is folded, at least acute triangle portions are raised, each of which is formed by each first cutting line segment 121 and each second cutting line segment 122. Accordingly, the cut-and-raised portions 12*b* are formed. Further, distance from the base to the apex in each cut-and-raised portion 12*b* is herein set to be longer than that in the well-known heat exchanger (PTL2). The contact amount is thereby increased between the cut-and-raised portions 12*b* of the wavy fins 12 disposed on given two vertically adjacent tiers. Consequently, condensed dew easily flows along the cut-and-raised portions 12*b*, and drainage performance is enhanced.

<First Modification>

Figure 4:
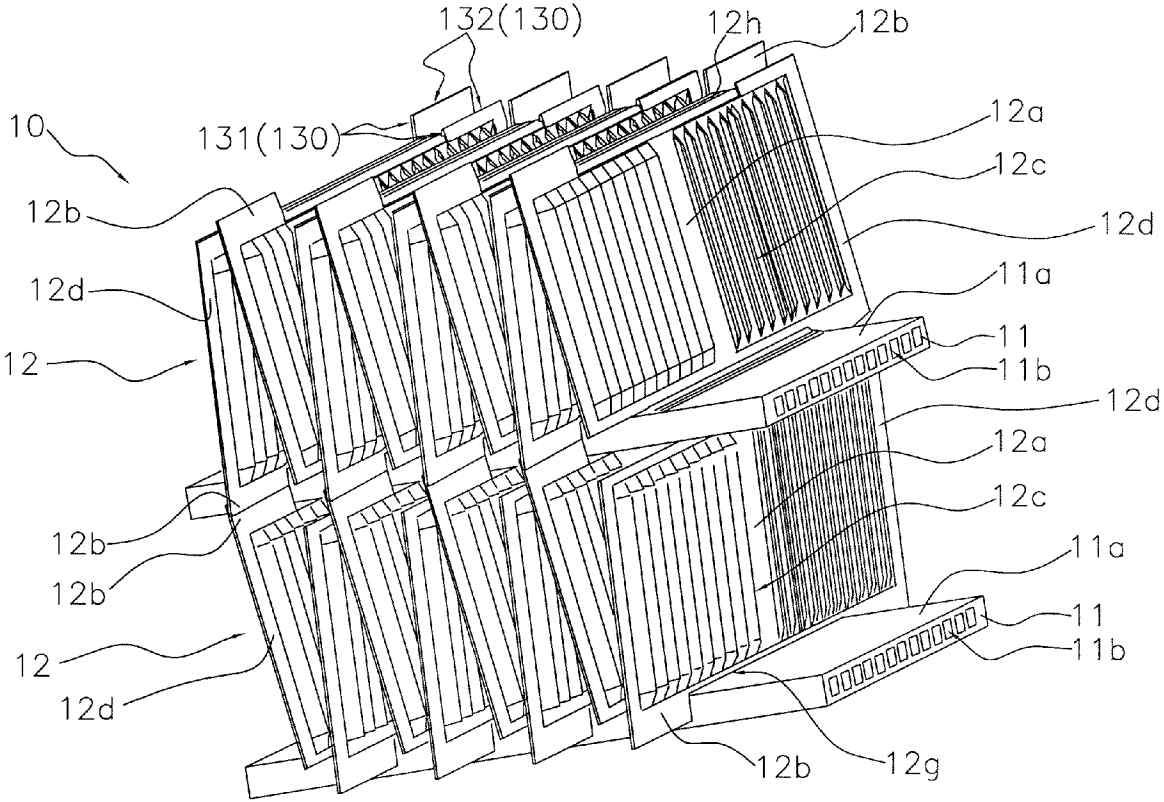
FIG. 4 is a perspective view of a heat exchanger according to a first modification.
Figure 5:
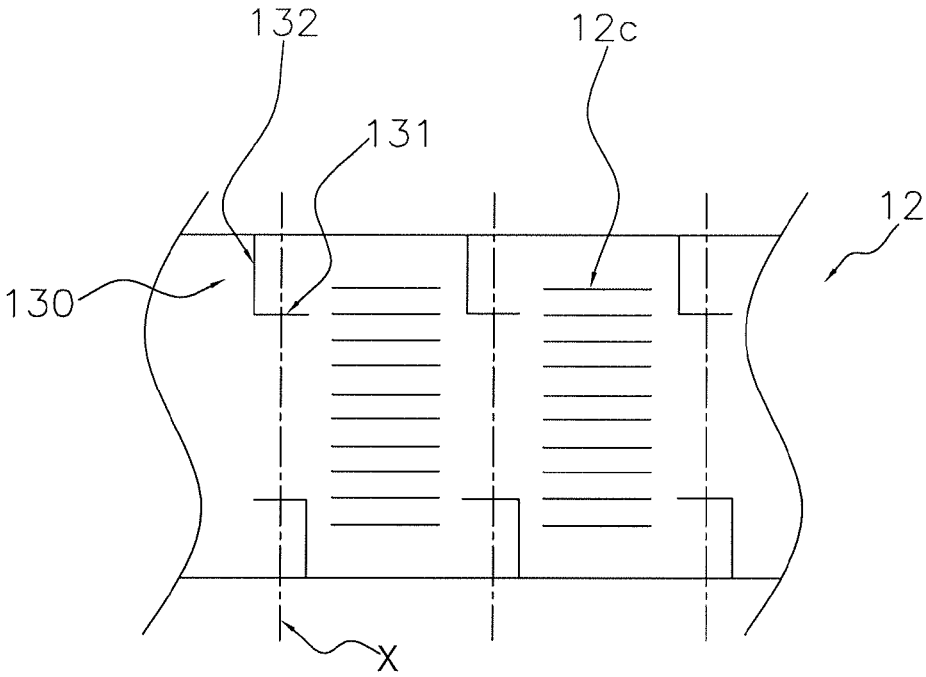
FIG. 5 is a plan view of a wavy fin of a pre-wavily-folded state in the heat exchanger according to the first modification.

In the aforementioned exemplary embodiment, each second cutting line segment 122 intersects with each hypothetical center line X. However, a relation between each cutting line segment and each hypothetical line is not limited to the above. FIG. 4 is a perspective view of a heat exchanger according to a first modification. FIG. 5 is a plan view of wavy fins of a pre-wavily-folded state in the heat exchanger according to the first modification.

In each prospective folded area illustrated in FIG. 5, first cutting line segments 131 are set in positions separated inwards from the both edges of the prospective folded area at a predetermined distance. The first cutting line segments 131 are perpendicular to a hypothetical center line X of the prospective folded area. An arbitrary length may be set for each first cutting line segment 131 as long as the length is roughly equal to the thickness of each flat tube 11. Further in each prospective folded area, second cutting line segments 132 are set to be in parallel to the hypothetical center line X. Each second cutting line segment 132 is extended from a terminal of each first cutting line segment 131 to an edge of the prospective folded area. The first and second cutting line segments 131, 132 will be hereinafter inclusively referred to as "cutting line segments 130".

As illustrated in FIG. 4, when each prospective folded area is actually folded in a mountain shape or a valley shape, rectangular portions are cut and raised, each of which is formed by each first cutting line segment 131, each second cutting line segment 132, and an edge of the prospective folded area. Accordingly, the rectangular portions are foamed as the cut-and-raised portions 12*b*. In each wavy fin 12, the cut-and-raised portions 12*b* are protruded upwards and downwards. Therefore, the cut-and-raised portions 12*b* of the wavy fins 12 on given two vertically adjacent tiers make contact with each other. According to the first modification, a contact area is further increased between the cut-and-raised portions 12*b* of the wavy fins 12 on given two vertically adjacent tiers compared to that in the aforementioned exemplary embodiment. Accordingly, condensed dew further easily flows along the cut-and-raised portions 12*b*.

<Second Modification>

Figure 6:
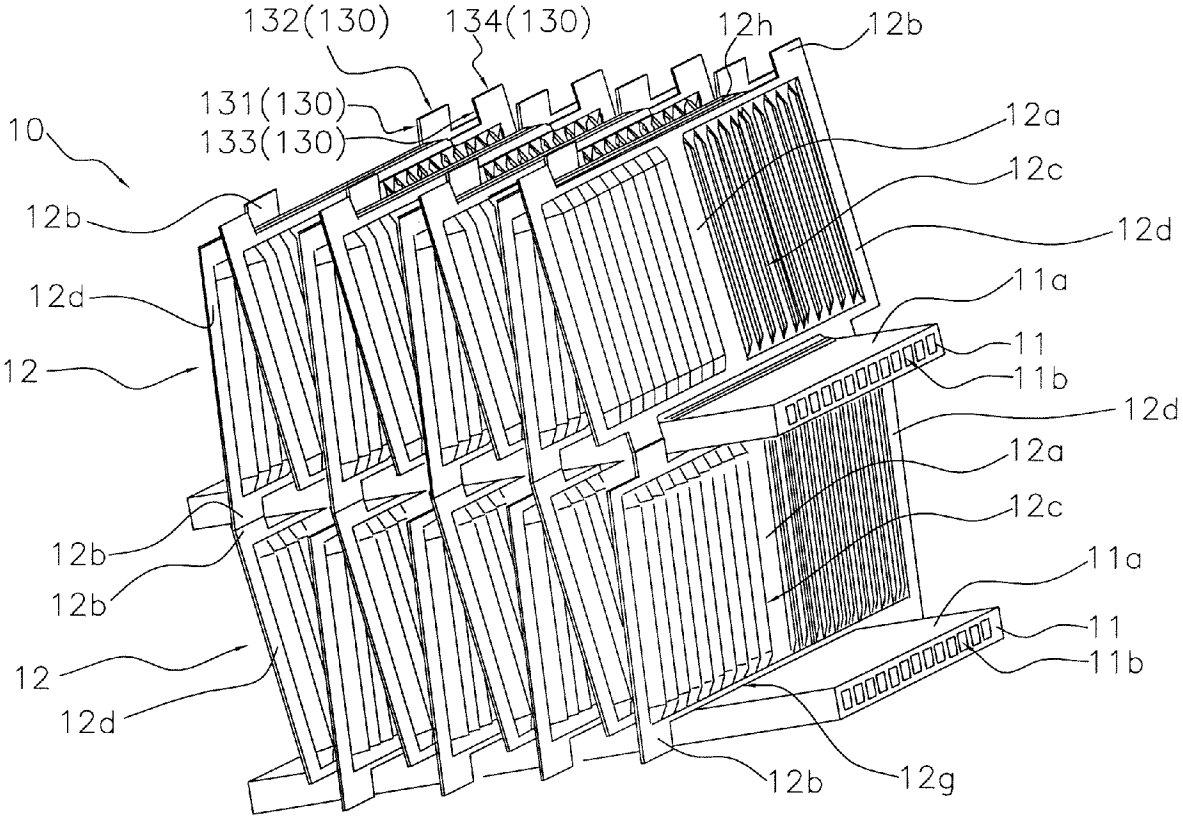
FIG. 6 is a perspective view of a heat exchanger according to a second modification.
Figure 7:
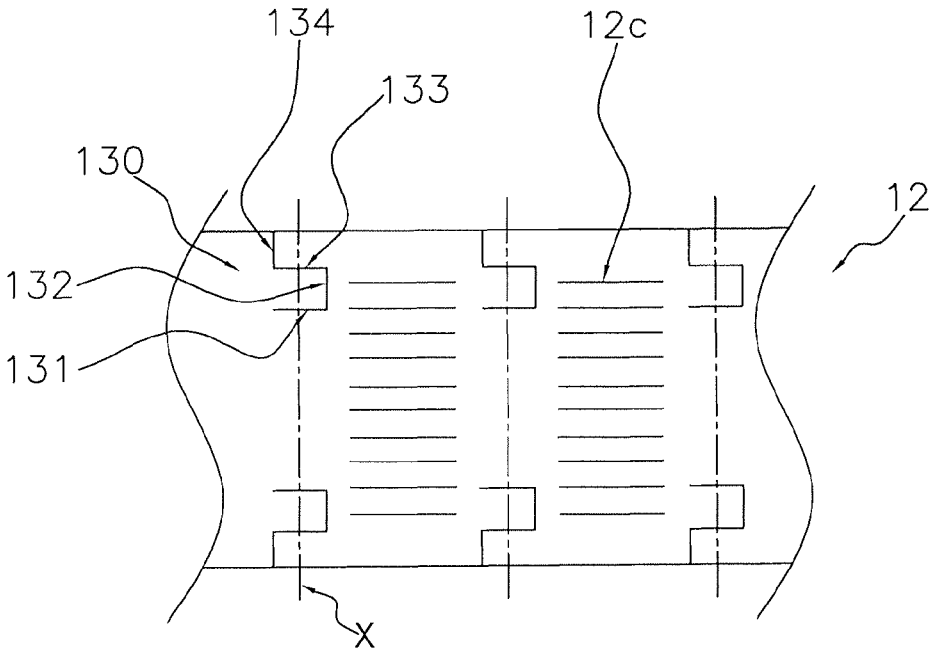
FIG. 7 is a plan view of a wavy fin of a pre-wavily-folded state in the heat exchanger according to the second modification.

Two cutting line segments 120 are set in each prospective folded area in the aforementioned exemplary embodiment, while two cutting line segments 130 are set in each prospective folded area in the aforementioned first modification. However, configuration of the cutting line segments is not limited to the above. FIG. 6 is a perspective view of a heat exchanger according to a second modification. FIG. 7 is a plan view of wavy fins of a pre-wavily-folded state in the heat exchanger according to the second modification.

In each prospective folded area illustrated in FIG. 7, first cutting line segments 131 are set in positions separated inwards from the both edges of the prospective folded area at a predetermined distance. The first cutting line segments 131 are perpendicular to a hypothetical center line X of the prospective folded area. An arbitrary length may be set for each first cutting line segment 131 as long as the length is roughly equal to the thickness of each flat tube 11.

In each prospective folded area, second cutting line segments 132 are further set to be in parallel to the hypothetical center line X. Each second cutting line segment 132 is extended from a terminal of each first cutting line segment 131 towards an edge of the prospective folded area. The length of each second cutting line segment 132 is set to be roughly half the distance from each first cutting line segment 131 to an edge of the prospective folded area.

Further, third cutting lines 133 are set in each prospective folded area. Each third cutting line segment 133 is extended from a terminal of each second cutting line segment 132. Each third cutting line segment 133 is set to be in parallel to each first cutting line segment 131. The length of each third cutting line segment 133 is equal to the length of each first cutting line segment 131.

Yet further, fourth cutting lines 134 are set in each prospective folded area. Each fourth cutting line segment 134 is extended from a terminal of each third cutting line segment 133 to an edge of the prospective folded area. Each fourth cutting line segment 134 is set to be in parallel to the hypothetical center line X. Each fourth cutting line segment 134 is positioned on the opposite side of each second cutting line segment 132 across the hypothetical center line X.

As illustrated in FIG. 6, when each prospective folded area is actually folded in a valley shape or a mountain shape, rectangular portions are cut and raised, each of which is formed by each first cutting line segment 131, each second cutting line segment 132, and each third cutting line segment 133 or formed by each third cutting line segment 133, each fourth cutting line segment 134, and an edge of the prospective folded area. Accordingly, the rectangular portions are formed as the cut-and-raised portions 12*b*. In each wavy fin 12, the cut-and-raised portions 12*b* are protruded upwards and downwards. Therefore, the cut-and-raised portions 12*b* of the wavy fins 12 on given two vertically adjacent tiers make contact with each other.

Features are herein compared among the aforementioned exemplary embodiment, the aforementioned first modification and the present second modification. According to the aforementioned exemplary embodiment, two cut-and-raised portions 12*b* are formed in a periphery of the cutting line segments as illustrated in FIG. 2. Therefore, the aforementioned exemplary embodiment achieves higher contact reliability between the cut-and-raised portions 12*b* of the wavy fins 12 on given two vertically adjacent tires, compared to the aforementioned first modification.

According to the aforementioned first modification, a single cut-and-raised portion 12*b* is only formed in a periphery of the cutting line segments as illustrated in FIG. 4. In spite of this, large contact area is formed between the cut-and-raised portions 12*b* of the wavy fins 12 on given two vertically adjacent tiers. Therefore, the contact area is greater than that in the aforementioned exemplary embodiment.

According to the second modification, the area of a single cut-and-raised portion 12*b* is half the area of a single cut-and-raised portion 12 in the aforementioned first modification as illustrated in FIG. 6. However, two cut-and-raised portions 12*b* are formed in a periphery of the cutting line segments. Therefore, the total contact area between the cut-and-raised portions 12*b* of the wavy fins 12 on given two vertically adjacent tiers is roughly the same as that in the first modification. Further, contact reliability between the cut-and-raised portions 12*b* of the wavy fins 12 on given two vertically adjacent tiers is roughly the same as that in the aforementioned exemplary embodiment.

Industrial Applicability

As described above, the heat exchanger according to the present invention has good drainage performance with respect to condensed dew even when the heat exchanger is disposed under the condition that the flat tubes are horizontally positioned. Therefore, the heat exchanger is useful as the heat exchangers for the air conditioners and the radiators for the automobiles.

What is claimed is:

1. A heat exchanger comprising:

a plurality of flat tubes disposed in a plurality of tiers, each of the flat tubes including a planar portion facing vertically; and at least one fin disposed in a wavily folded state in a ventilation space interposed between a pair of the flat tubes disposed on two vertically adjacent tiers, the fin including a heat transfer portion having a folded portion joined to the planar portion of each of the pair of flat tubes, and a cut-and-raised portion protruded from the ventilation space, the cut-and-raised portion being formed by raising a periphery of a cutting line segment when a material of the fin is wavily folded, the cutting line segment being set in a vicinity of a center line lying on an apex of the folded portion before the material of the fin is wavily folded, the cutting line segment being formed by a combination of cutting line segments intersecting with the center line or a combination of a cutting line segment intersecting with the center line and a cutting line segment displaced with respect to the center line, the combination of cutting line segments being disposed latterly adjacent to the flat tube and being asymmetrical relative the center line of the folded portion prior to being folded such that adjacent cut and raised parts on opposite sides of the center line have different outer peripheral shapes as viewed along the heat transfer tube adjacent thereto.

2. The heat exchanger according to claim 1, wherein the cutting line segment includes a first cutting line segment intersecting the center line; and a second cutting line segment intersecting the center line, the second cutting line segment being extended from a vicinity of a terminal of the first cutting line segment.

3. The heat exchanger according to claim 1, wherein the cutting tine segment includes a first cutting line segment intersecting the center line; and a second cutting line segment without intersecting the center line, the second cutting line segment being extended from a vicinity of a terminal of the first cutting line segment.

4. The heat exchanger according to claim 1, wherein the cutting line segment includes a first cutting line segment intersecting the center line;

a second cutting line segment without intersecting the center line, the second cutting line segment being extended from a vicinity of a terminal of the first cutting line segment;

a third cutting line segment intersecting the center line, the third cutting line segment being extended from a vicinity of a terminal of the second cutting line segment;

a fourth cutting line segment not intersecting the center line, the fourth cutting line segment being extended from a vicinity of a terminal of the third cutting line segment.

* * * * *

UNITED STATES PATENT AND TRADEMARK OFFICE

CERTIFICATE OF CORRECTION

PATENT NO. : 8,910,703 B2
APPLICATION NO. : 12/997076
DATED : December 16, 2014
INVENTOR(S) : Hyunyoung Kim et al.

It is certified that error appears in the above-identified patent and that said Letters Patent is hereby corrected as shown below:

In the Claims

Column 9,
Line 18, Claim 3 "the cutting tine segment includes" should read -- the cutting line segment includes --

Signed and Sealed this
Second Day of June, 2015

Michelle K. Lee

Michelle K. Lee
*Director of the United States Patent and Trademark Office*